United States Patent [19]

Bobbe

[11] 4,068,940

[45] Jan. 17, 1978

[54] VARIABLE CONTRAST OPTICAL SCREENING SYSTEM

[75] Inventor: Richard M. Bobbe, Rochester, N.Y.

[73] Assignee: Xerox Corporation, Stamford, Conn.

[21] Appl. No.: 722,448

[22] Filed: Sept. 13, 1976

[51] Int. Cl.[2] ..... G03G 15/01

[52] U.S. Cl. ..... 355/4; 355/69

[58] Field of Search ..... 355/3 R, 4, 11, 69, 355/71

[56] References Cited

U.S. PATENT DOCUMENTS 4,007,981 2/1977 Goren ..... 355/4

*Primary Examiner*—Richard L. Moses

*Attorney, Agent, or Firm*—J. J. Ralabate; C. A. Green; H. Fleischer

[57] ABSTRACT

An electrophotographic printing machine in which a latent image of an original document and a screen pattern are formed on a photoconductive member in superimposed registration with one another. The contrast of the screen pattern is regulated.

8 Claims, 2 Drawing Figures

VARIABLE CONTRAST OPTICAL SCREENING SYSTEM

BACKGROUND OF THE INVENTION

This invention relates generally to an electrophotographic printing machine, and more particularly concerns a printing machine wherein the latent image recorded on the photoconductive member is modulated by a screen pattern having a regulatable contrast.

In a typical electrophotographic printing machine, a latent image is recorded on a photoconductive member and developed with toner particles. A sheet of support material is positioned closely adjacent to the latent image and arranged to have the particles transferred thereto. After the particles are transferred to the sheet of support material, they are permanently affixed thereto forming a copy of the original document. The latent image is recorded on the photoconductive member by projecting a light image of the original document onto the charged portion thereof. This dissipates the charge in accordance with the intensity of the light image to record the electrostatic latent image on the photoconductive member.

Multi-color electrophotographic printing is essentially the same as black and white printing. However, in multi-color printing, the foregoing is repeated a plurality of cycles, each cycle being for a discrete color. In this process, the light image is filtered to record an electrostatic latent image on the photoconductive member corresponding to a single color. A plurality of different single color light images are formed. Each single color electrostatic latent image is developed with toner particles complementary in color to the color of the filtered light image. The toner powder images are transferred to the sheet of support material in superimposed registration with one another. Heat is then applied to the multi-layered toner powder image permanently affixing it to the sheet of support material. This produces a permanent color copy of the original document.

Pictorial copies may be reproduced by employing a half-tone screen to form tone gradations. The screen produces tonal gradations by forming half-tone dots or lines of varying size. In the highlight regions, the half-tone pattern may comprise narrow lines or small dots. The lines increase in width or the dots in size throughout the intermediate shades until they merge together at the shadow end. This results in nearly complete whiteness at the highlight end and nearly solid blackness at the shadow end of the tonal scale.

Various patents such as U.S. Pat. Nos. 2,598,732; 3,535,036; 3,121,010; 3,493,381; 3,776,633; and 3,809,555 teach the concept of screening. In general, the light image of the original document may be projected through the screen prior to exposing the charged portion of the photoconductive surface so as to produce a half-tone electrostatic latent image on the photoconductive surface. However, a system of this type requires high intensity lamps in order to provide sufficient light to illuminate the original document and have the reflected light rays pass through the screen onto the charged portion of the photoconductive member. This problem may be eliminated by projecting a light image of the screen pattern onto the charged portion of the photoconductive member prior to, or subsequent to the projection of the light image of the original document thereon. In this type of operation, the latent image of the screen pattern is recorded in superimposed registration with the latent image of the original document so as to record a modulated latent image on the photoconductive member. Hereinbefore, systems of this type employed a light source having a substantially constant illumination for irradiating the screen. However, it has been found that a constant light source does not permit variations of contrast nor does it readily facilitate changing the process response curve.

Accordingly, it is a primary object of the present invention to control the intensity of illumination irradiating the screen member so as to regulate contrast and adjust the process response curve.

SUMMARY OF THE INVENTION

Briefly stated, and in accordance with the present invention, there is provided an electrophotographic printing machine for reproducing an original document.

Pursuant to the features of the present invention, means record a latent image of the original document on a photoconductive member. Means are provided for forming a screen pattern on the photoconductive member. The latent image of the original document and the screen pattern are recorded on the photoconductive member in superimposed registration with one another. Control means regulate the contrast of the screen pattern formed on the photoconductive member.

BRIEF DESCRIPTION OF THE DRAWINGS

Other objects and advantages of the present invention will become apparent upon reading the following detailed description and upon reference to the drawings, in which.

While the present invention will be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
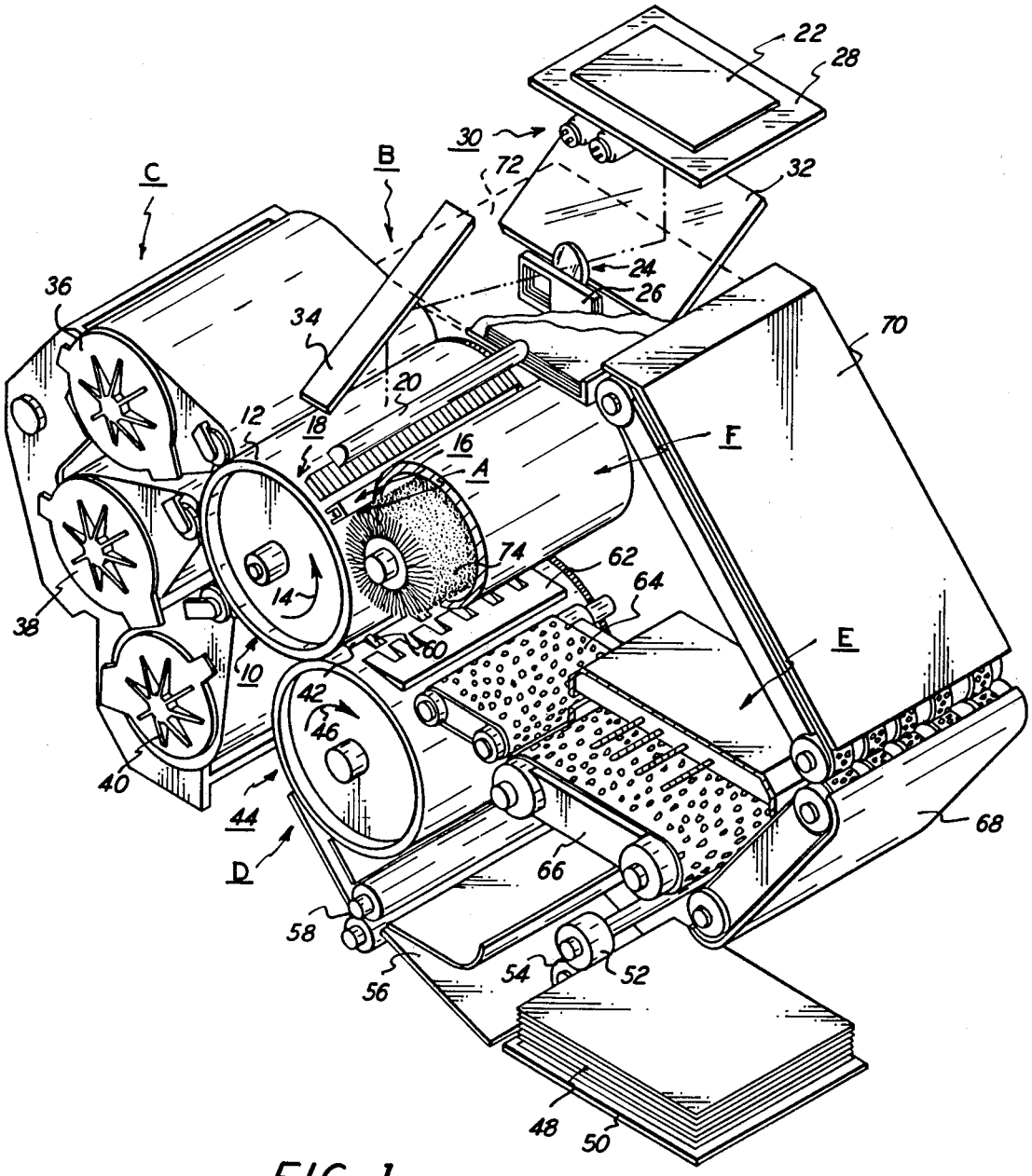
FIG. 1 is a schematic, perspective view of an electrophotographic printing machine incorporating the features of the present invention therein.

A general understanding of an electrophotographic printing machine incorporating the features of the present invention therein may be had by referring to the drawings. In the drawings, like reference numerals have been used throughout to designate identical elements. As shown in FIG. 1, the electrophotographic printing machine is arranged to reproduce original documents which may be amongst others in the form of single sheets, books, three-dimensional objects, or slides.

Turning now to FIG. 1, the electrophotographic printing machine includes a photoconductive member having a rotatable mounted drum 10 with a photoconductive surface 12 entrained thereabout and secured thereto. Drum 10 is mounted on a shaft (not shown) and rotates in the direction of arrow 14. This moves photoconductive surface 12 sequentially through a series of processing stations. Preferably, photoconductive surface 12 is made from a suitable selenium alloy such as is described in U.S. Pat. No. 3,655,377 issued to Sechak in 1972.

A timing disc 76 (FIG. 2) is mounted on one end of the shaft of drum 10. This timing disc cooperates with a light source 82 (FIG. 2) and a pair of photosensors 84 and 88 (FIG. 2) to produce an electrical signal indicative of the position of drum 10. This signal is coupled to the machine logic to activate the appropriate processing station. The detailed operation of the timing disc 76, photosensors 84 and 88 and light source 82 will be discussed hereinafter in greater detail with reference to FIG. 2.

For purposes of the present disclosure, various processing stations employed in the printing machine will be discussed briefly hereinafter.

As drum 10 rotates in the direction of arrow 14, a portion thereof initially passes through charging station A. Charging station A includes a corona generating device, indicated generally by the reference numeral 16. Corona generating device 16 charges at least a portion of photoconductive surface 12 to a relatively high substantially uniform level. Preferably, corona generating device 16 extends in a generally transverse direction across photoconductive surface 12 to produce a spray of ions for the charging thereof. One type of suitable corona generating device is described in U.S. Pat. No. 3,944,356 issued to Hayne in 1976.

Next, drum 10 rotates the charged portion of photoconductive surface 12 to exposure station B. At exposure station B, a screen member, indicated generally by the reference numeral 18, has light rays projected therethrough from light source 20. In this manner, a light image of a screen pattern irradiates the charged portion of photoconductive surface 12 forming a charge pattern thereon corresponding to the screen pattern. While screen 18 and light source 20 have been illustrated as being prior to the optical light path projecting the light image of the original document onto photoconductive surface 12, one skilled in the art will appreciate that this is not necessary and the screen and light source may be located subsequent to the projection of the light image at the original document onto photoconductive surface 12. Continuing now with a description of exposure station B, a color filtered light image of original document 22 is projected, in superimposed registration, onto the screen charge pattern recorded on photoconductive surface 12. In this way, a single color electrostatic latent image is recorded on photoconductive surface 12, in superimposed registration, with the screen charge pattern so as to produce a modulated or halftone single color electrostatic latent image thereon. As depicted in FIG. 1, a moving lens system, generally designated by the reference numeral 24, and a color filter mechanism, shown generally at 26, are positioned at exposure station B. U.S. Pat. No. 3,062,108 issued to Mayo in 1952 describes a moving lens system suitable for use in electrophotographic printing. A suitable color filter mechanism is described in U.S. Pat. No. 3,755,006 issued to Hartman et al. in 1973. Original document 22 is disposed upon a transparent viewing platen 28. Lamp assembly 30, located beneath transparent platen 28, and, in conjunction with lens system 24 and filter machanism 26, move in a timed relationship with drum 10 to scan successive incremental areas of original document 22. Preferably, lens 24 is a six element split dagor type of lens having front and back compound components with a diaphragm located centrally therebetween. The front lens component has three lens elements including in the following order; a first lens element of positive power, a second lens element of negative power, cemented to the first lens element, and a third lens element of positive power disposed between the second lens element and diaphragm. Preferably, the first lens element has a double convex lens as the front component, a concave lens as the second component, and a convex-concave lens as the third component. Lens 18 has a preferred speed ranging from about F/4.5 to about F/8.0. A suitable type of lens is described in U.S. Pat. No. 3,592,531 issued to McCrobie in 1971. In this manner, light rays reflected from original document 22 are directed by mirror 32 through lens 24 and filter 26 onto mirror 34. Mirror 34, in turn, directs the flowing light image onto photoconductive surface 12 in superimposed registration with the screen charge pattern recorded thereon. Successive color filters operate on the light rays passing through lens 24 to create a single color light image which records a modulated single color electrostatic latent image on photoconductive surface 12. Light source 20 which transmits light rays through screen 18 is controlled so that the intensity of illumination emitted therefrom is varied as a function of the color of the light image being projected onto photoconductive surface 12. Thus, the intensity of illumination emitted from light source 20 is varied as a function of the color of the filter interposed into the optical light path by filter mechanism 26. The detailed operation of this structure will be discussed hereinafter with reference to FIG. 2.

After the electrostatic latent image is recorded on photoconductive surface 12, drum 10 rotates to development station C. Three developer units, generally indicated by the reference numerals 36, 38 and 40, are positioned at development station C. A suitable development station employing a plurality of developer units (in this case three) is described in U.S. Pat. No. 3,854,449 issued to Davidson in 1974. The developer units described therein are all of the type usually referred to in the art as magnetic brush developer units. Generally, a magnetic brush developer unit employs a magnetizable developer mix comprising ferro-magnetic carrier granules and thermosettable toner particles. The developer unit forms a directional flux field to continually create a brush of developer mix. This developer mix brush is brought into contact with the modulated single color electrostatic latent image recorded on photoconductive surface 12. The toner particles adhering electrostatically to the carrier granules of the developer mix are attracted by the greater electrostatic force to the latent image, thereby rendering it visible. Developer units 36, 38 and 40 respectively, contain discretely colored toner particles. Each of the toner particles contained in the respective developer unit corresponds to the complement of the single color light image transmitted through each of three differently colored filters. For example, a modulated single color electrostatic latent image formed from a green filtered image is rendered visible by depositing green absorbing magenta toner particles thereon using one of the developer units. Similarly, electrostatic latent images formed from blue and red light images are developed with the yellow and cyan toner particles contained in the other two developer units.

After the modulated electrostatic latent image recorded on photoconductive surface 12 is developed, drum 10 rotates to transfer station D. At transfer station D, the toner powder image adhering electrostatically to photoconductive surface 12 is transferred to a copy sheet or a sheet of support material 42. An electrically biased transfer roll, shown generally at 44, recirculates support material 42. Transfer roll 44 is electrically biased to a potential of sufficient magnitude and polarity to electrostatically attract toner particles from photoconductive surface 12 to copy sheet 42. Transfer roll 44 rotates in the direction of arrow 46, at substantially the same tangential velocity as drum 10. Thus, as transfer roll 44 rotates in synchronism with drum 10, successive toner powder images may be transferred from photoconductive surface 12 to sheet 42, in superimposed registration with one another. A suitable electrically biased transfer roll is described in U.S. Pat. No. 3,612,677 issued to Langdon et al. in 1971.

Prior to proceeding with the remaining processing stations disposed about the periphery of drum 10, the sheet feeding path will be briefly described. Support material 42 is advanced from a stack 48 thereof disposed upon tray 50. Feed roll 52, in operative communication with retard roll 54, separates and advances the uppermost from stack 48. The advancing sheet moves into chute 56 and is directed thereby into the nip of register rolls 58. Register rolls 58 align and forward the advancing sheet, in synchronism with the movement of transfer roll 44. Transfer roll 44 has gripper fingers 60 mounted thereon. Gripper fingers 60 receive advancing sheet 42 and secure it releasably to transfer roll 44. After the requisite number of toner powder images have been transferred to sheet 42, in superimposed registration with one another, sheet 42 is removed from transfer roll 44. The foregoing is achieved by having gripper fingers 60 space sheet 42 from transfer roll 44 as it rotates in the direction of arrow 46. This permits stripper bar 62 to be interposed therebetween separating sheet 42 from transfer roll 44. Sheet 42 passes over stripper bar 62 onto conveyor 64. Endless belt conveyor 64 moves sheet 42 to fixing station E.

At fixing station E, a fuser, indicated generally by the reference number 66, permanently affixes the transferred toner powder images to sheet 42. One type of suitable fuser is described in U.S. Pat. No. Re. 28,802 issued to Draugelis et al. in 1976. After the fixing process, sheet 42 is advanced by endless belt conveyors 68 and 70 to catch tray 72 for subsequent removal therefrom by the machine operator.

Frequently, following the transfer process, residual toner particles remain adhering to photoconductive surface 12. Cleaning station F, the final processing station in the direction of rotation of drum 10, as indicated by arrow 14, removes these residual toner particles. A preclean corona generating device (not shown) neutralizes the charge on photoconductive surface 12 and that of the residual toner particles. This enables fibrous brush 74, in contact with photoconductive surface 12, to remove the residual toner particles therefrom. A suitable brush cleaning system is described in U.S. Pat. No. 3,590,412 issued to Gerbasi in 1971.

Screen member 18 may include a plurality of substantially opaque lines printed on substantially transparent substrate by a suitable chemical etching technique, or by a photographic technique. The screen itself may be made from any number of opaque metallic materials suitable for chemical etching such as copper or aluminum. The transparent portion may be formed from glass or a suitable plastic. The lines are substantially equally spaced with a finer screen size resulting in a more natural or higher quality copy. By way of example, screen member 28 preferably has about 130 lines per inch.

It is believed that the foregoing description is sufficient for purposes of the present application to illustrate an electrophotographic printing machine having the features of the present invention incorporated therein.

Figure 2:
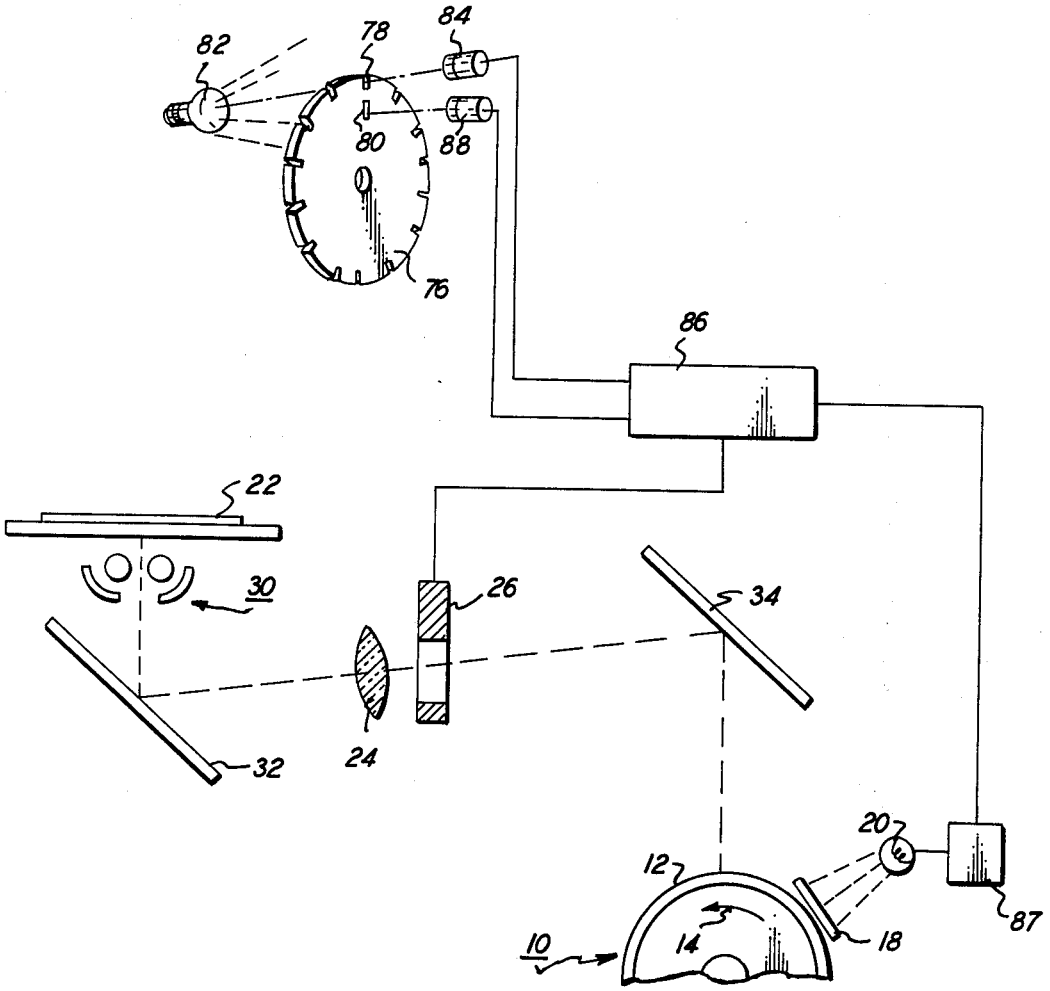
FIG. 2 is an elevational view of the optical system employed in the FIG. 1 printing machine.

Referring now to FIG. 2, there is shown, in detail, exposure station B. As depicted therein, original document 22 disposed upon transparent platen 28 is illuminated by light source 30. The light rays reflected from original document 22 are directed by mirror 32 through lens 24 and filter mechanism 26. Filter mechanism 26 interposes a selected filter into the optical light path. The resultant single color light image is then reflected by mirror 34 onto photoconductive surface 12 in superimposed registration with the screen pattern recorded thereon.

Turning initially to the structure of filter mechanism 26, filter mechanism 26 includes a housing having a plurality of tracks therein. The housing comprises a window through which the light image passes. One optical filter at a time is positioned in the housing window to filter the light image creating a single color light image. Each single color light image is of a different color. Thus, a blue filter may be located in the housing window, a red filter, and a green filter. In this manner, red, blue, and green single color light images are formed. Each filter is connected to a spring which retains the filter in the inoperative position spaced from the housing window. A solenoid is associated with each filter. Thus, activation of a solenoid causes a selected filter to move along the track to be positioned in the housing window. When the solenoid remains inactivated, the spring retains the filter in the inoperative position spaced from the housing window. Activation of the selected solenoid is achieved by the machine logic.

Referring now to a brief description of the means by which the appropriate filter is moved into the optical light path, timing wheel 76 is mounted on the shaft of drum 10 and rotates therewith. Timing wheel 76 comprises a plurality of slits 78 in the outer periphery thereof. In one position, a second slit 80 is located adjacent to a first slit 78. Thus, after each 360° rotation of timing wheel 76, two slits are positioned in alignment with light source 82 permitting light rays to be transmitted therethrough. Timing wheel 76 is substantially opaque. The light rays transmitted through slits 78 and 80 are detected by photosensors or photodarlingtons 84 and 88. Photodarlingtons 84 and 88 develop electrical output signals when energized by light rays. This signal is processed by logic circuitry 86. Thus, photodarlington 84 develops an electrical output signal when light rays pass through slit 78. Similarly, photodarlington 88 develops an electrical output signal when light rays are transmitted through slit 80. These electrical output signals are processed by logic circuitry 86. Logic circuitry 86 acts as a switching device to develop an electrical output signal which energizes one of the solenoids to move an optical filter into the light path when light rays are transmitted through slits 78 and 80. Thus, logic circuitry 86 develops an electrical output signal when photodarlingtons 84 and 88 provide an electrical input signal thereto. Logic circuitry 86 is arranged to activate each of three solenoids sequentially in response to detecting three successive pairs of signals from photodarlingtons 84 and 88, i.e., it switches the activation to different solenoids at the end of each machine cycle. Thus, logic circuitry 86 activates the first solenoid to interpose one optical filter into the light path during the first cycle, a second solenoid to interpose the next optical filter into the light path during the next cycle, and the third solenoid to interpose the final optical filter into the light path. By way of example, initially, photodarlings 84 and 88 develop an electrical output signal indicating that slits 78 and 80 have light rays transmitted therethrough. These electrical outputs signals are processed by logic circuitry 86 to activate one solenoid which advances the blue filter into the optical light path. As timing wheel 76 continues to rotate, the latent image corresponding to the blue light image is developed and transferred to the sheet of support material. After the blue cycle in completed, slits 78 and 80 are once again in alignment with photodarlingtons 834 and 88. Logic circuitry 86 then receives the next pair of signals from photodarlingtons 84 and 88. This signal switches the activation signal from the first solenoid to the second solenoid. Inactivation of the first solenoid permits the spring associated with the blue filter to retract the blue filter to the inoperative position remote from the housing window. Activation of the second solenoid advances the green filter into the optical light path. After the green cycle is completed, slits 78 and 80 are once again in alignment with photodarlingtons 84 and 88. Thus, photodarlingtons 84 and 88 develop the third pair of signals which are processed once again by logic circuitry 86 to produce a signal activating the third solenoid while inactivating the second solenoid. Inactivation of the second solenoid permits the spring associated with the green filter to retract the green filter from the housing window. Substantially simultaneously therewith, the third solenoid is activated advancing the red filter into the housing window. After the red cycle is completed, three layers of toner particles have been transferred to the sheet of support material producing a multi-color copy. This multi-color copy is then permanently affixed to the sheet of support material as heretofore described at fixing station E.

In addition to advancing each of the successive optical filters into the light path, logic circuitry 86 regulates the output voltage of power supply 87. Power supply 87 excites lamp 20 at about 30 watts, 37 volts, and 1.5 amps RMS. By adjusting this voltage, the illumination emitted from light source 20 is varied. For example, power supply 87 will be excited at 37 volts when the blue filter is interposed into the optical light path. Logic circuitry 86 adjusts power supply 87 to excite lamps 20 at a lower value when the green filter is interposed into the optical light path, i.e., to about 30 volts, thereby reducing the illumination emitted from light source 20 to optimize the response characteristics of the photoconductive surface and change the contrast of the screen pattern recorded thereon. Finally, logic circuitry 86 adjusts power supply 87 to further reduce the voltage exciting lamp 20 when the red filter is interposed into the optical light path, i.e., to about 23 volts. In this way, the intensity of illumination emitted from light source 20 varies as a function of the single color light image being recorded on photoconductive surface 12. Hence, the contrast of the screen pattern or intensity thereof is adjusted as the function of the single color light image being superimposed over the screen pattern on photoconductive surface 12. In this manner, the response characteristics of photoconductive surface 12 may be optimized to form high contrast color copies.

In recapitulation, it is evident that the exposure system of the electrophotographic printing machine adjusts the intensity of the screen pattern recorded on the photoconductive surface in conformance to the color of the single color light image being projected in superimposed registration therewith. This substantially improves the response curve of the system and improves copy quality.

It is, therefore, apparent that there has been provided in accordance with the present invention an electrophotographic printing machine having an optical system that fully satisfies the objects, aims and advantages hereinbefore set forth. While the present invention has been described in connection with a specific embodiment thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. An electrophotographic printing machine for reproducing an original document, including:

a photoconductive member;

means for charging at least a portion of said photoconductive member to a substantially uniform level;

means for exposing the charged portion of said photoconductive member to a light image of the original document to record thereon the latent image thereof;

means for filtering the light image to expose the charged portion of said photoconductive member to successively differently colored light images corresponding to different colors of the original document;

a screen member;

a first light source arranged to project light rays through said screen member forming a screen pattern on said photoconductive member;

a power supply coupled to said first light source; and means, responsive to the color of the light image exposing said photoconductive member, for adjusting said power supply to vary the voltage exciting said first light source to regulate the intensity of the light rays emitted from said first light source.

2. A printing machine as recited in claim 1 wherein said screen member includes a plurality of substantially equally spaced lines.

3. A printing machine was recited in claim 2, wherein said exposing means includes:

a second light source for illuminating the original document;

a lens in a light receiving relationship with the light rays transmitted from the original document to form a light image thereof; and means for directing the light image of the original document onto the charged portion of said photoconductive member.

4. A printing machine as recited in claim 3, wherein said filtering means includes:

a blue filter;

a red filter; and a green filter.

5. An optical system for exposing a photosensitive member, including:

first means for projecting a light image of an original document onto the photosensitive member to record thereon a latent image thereof;

means for filtering the light image of the original document to form successive differently colored light images thereof;

a screen member;

a first light source arranged to project light rays through said screen member forming a light image of the screen pattern;

a power supply coupled to said first light source; and means, responsive to the color of the light image of the original document, for adjusting said power supply to vary the voltage exciting said first light source to regulate the intensity of the light rays emitted from said first light source.

6. An optical system as recited in claim 5, wherein said screen member includes a plurality of substantially equally spaced lines.

7. An optical system as recited in claim 6, wherein said first projecting means includes:

a second light source for illuminating the original document; and a lens, in a light receiving relationship with the light rays transmitted from the original document, to produce a light image thereof.

8. An optical system as recited in claim 7, wherein said filtering means includes:

a blue filter;

a red filter; and a green filter.

* * * * *